US011804684B2

(12) United States Patent
Sato

(10) Patent No.: US 11,804,684 B2
(45) Date of Patent: Oct. 31, 2023

(54) TERMINAL-ATTACHED ELECTRIC WIRE MANUFACTURING METHOD

(71) Applicant: Yazaki Corporation, Tokyo (JP)

(72) Inventor: Kei Sato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 55 days.

(21) Appl. No.: 17/376,671

(22) Filed: Jul. 15, 2021

(65) Prior Publication Data

US 2022/0029313 A1 Jan. 27, 2022

(30) Foreign Application Priority Data

Jul. 22, 2020 (JP) ..... 2020-124833

(51) Int. Cl.
*H01R 43/02* (2006.01)

(52) U.S. Cl.
CPC ..... *H01R 43/0221* (2013.01)

(58) Field of Classification Search
CPC ..... B29C 65/1403; B29L 2031/3425; H01L 21/6835; H01L 21/6836; H01L 2221/68322; H01L 2221/68331
See application file for complete search history.

(56) References Cited

U.S. PATENT DOCUMENTS

| | | | | |
|---|---|---|---|---|
| 11,489,306 | B2 * | 11/2022 | Sato | H01R 43/0221 |
| 2010/0270275 | A1 | 10/2010 | Nakamae | |
| 2014/0144016 | A1 | 5/2014 | Bauer et al. | |
| 2022/0029313 | A1 * | 1/2022 | Sato | H01R 43/0221 |
| 2022/0029369 | A1 * | 1/2022 | Sato | H01R 43/0221 |

FOREIGN PATENT DOCUMENTS

| | | | |
|---|---|---|---|
| JP | 06-056969 | U | 8/1994 |
| JP | 2010-253500 | A | 11/2010 |
| JP | 2012-38722 | A | 2/2012 |
| JP | 2013-536552 | A | 9/2013 |
| JP | 6034029 | B2 | 11/2016 |

* cited by examiner

*Primary Examiner* — Minh N Trinh
(74) *Attorney, Agent, or Firm* — Sughrue Mion, PLLC

(57) ABSTRACT

A method including an electric wire placing step for inserting a core-wire exposing portion of a terminal end of an electric wire between inner wall surfaces of a pair of piece portions of a terminal fitting that has a core wire connector composed of a bottom portion and the piece portions projected from two opposite ends of the bottom portion; and an electric wire holding-down step for holding down, by use of a holding-down jig made of a laser-transmissive material having a higher melting point than the core-wire exposing portion and the core wire connector have, the core-wire exposing portion from one sides of free ends of the piece portions and pressing the core-wire exposing portion against an inner wall surface of the bottom portion by use of the holding-down jig.

4 Claims, 13 Drawing Sheets

TERMINAL-ATTACHED ELECTRIC WIRE MANUFACTURING METHOD

CROSS-REFERENCE TO RELATED APPLICATION(S)

The present application claims priority to and incorporates by reference the entire contents of Japanese Patent Application No. 2020-124833 filed in Japan on Jul. 22, 2020.

BACKGROUND OF THE INVENTION

1. Field of the Invention

The present invention relates to terminal-attached electric wire manufacturing method and apparatus.

2. Description of the Related Art

Conventionally, a terminal-attached electric wire obtained by physically and electrically connecting a terminal fitting to a terminal end of an electric wire has been known. Furthermore, relating to the terminal-attached electric wire, known techniques for physically and electrically connecting together an electric-wire connector of the terminal fitting and a core wire at a terminal end of the electric wire include laser-welding together the electric-wire connector and the core wire. For example, terminal-attached electric wires of this type are disclosed in Japanese Utility Model Application Laid-open No. H6-56969 and Japanese Patent No. 6034029.

The terminal-attached electric wire disclosed in Japanese Utility Model Application Laid-open No. H6-56969 is obtained by: mounting, on a bottom portion of the electric-wire connector, a previously flattened core wire at a terminal end of the electric wire; temporarily fixing the core wire to the electric-wire connector by use of a piece body included in the terminal fitting and folded onto the core wire; and laser-welding together the electric-wire connector and the core wire. Consequently, this terminal-attached electric wire disclosed in Japanese Utility Model Application Laid-open No. H6-56969 involves a risk of having an element wire hanging out of the electric-wire connector, for example, in such a manner that element wires forming the core wire unravel at a flattening step or at the temporarily fixing step using the piece body. In the case of the terminal-attached electric wire disclosed in Japanese Patent No. 6034029, a terminal fitting is provided with guiding means configured to hold down a terminal end of an electric wire and thereby prevent element wires from unraveling, and laser-welding is performed with the element wires kept from unraveling by the guiding means. In this conventional terminal-attached electric wire, however, the terminal fitting needs a device for preventing unraveling of the element wires, thus having room for improvement in terms of the versatility of the terminal fitting.

SUMMARY OF THE INVENTION

Accordingly, the present invention is directed to providing terminal-attached electric wire manufacturing method and apparatus that are capable of preventing unraveling of element wires without providing a terminal fitting with a device for preventing unraveling of element wires.

To achieve the above objection, a terminal-attached electric wire manufacturing method according to one aspect of the invention includes an electric wire placing step for inserting a core-wire exposing portion at a terminal end of an electric wire between inner wall surfaces of a pair of piece portions of a terminal fitting that has a core wire connector composed of a bottom portion and the piece portions, the piece portions being projected from two opposite ends of the bottom portion; an electric wire holding-down step for holding down, by use of a holding-down jig, the core-wire exposing portion from sides of free ends of the piece portions and pressing the core-wire exposing portion against an inner wall surface of the bottom portion by use of the holding-down jig, the holding-down jig being made of a laser-transmissive material that has a higher melting point than the core core-wire exposing portion that is composed of a plurality of element wires and the core wire connector have; a melting step for irradiating the core-wire exposing portion with a laser beam through the holding-down jig from the sides of the free ends of the piece portions until the core-wire exposing portion is melted; and a fixing step for bonding, with stopping irradiation with the laser beam and removing the holding-down jig, the core-wire exposing portion to the core wire connector while solidifying the core-wire exposing portion melted by the laser beam.

According to another aspect of the present invention, in the terminal-attached electric wire manufacturing method, it is preferable that the electric wire holding-down step includes inserting, between the respective inner wall surfaces of the piece portions, the core-wire exposing portion of the electric wire that has a core wire diameter smaller than a projection height of the respective piece portions from a lowermost surface of the bottom portion.

According to still another aspect of the present invention, in the terminal-attached electric wire manufacturing method, it is preferable that the melting step includes irradiating the core-wire exposing portion with the laser beam that has passed through a laser passage portion of the holding-down jig.

To achieve the above objection, a terminal-attached electric wire manufacturing apparatus according to still another aspect of the invention includes a terminal mount configured to have a terminal fitting mounted thereon, the terminal fitting having a core wire connector composed of a bottom portion and a pair of piece portions projected from two opposite ends of the bottom portion; a holding-down jig made of a laser-transmissive material having a higher melting point than the core wire connector and a core-wire exposing portion at a terminal end of an electric wire inserted between inner wall surfaces of the pair of piece portions have, the holding-down jig being configured to hold down the core-wire exposing portion from sides of free ends of the piece portions and press the core-wire exposing portion against an inner wall surface of the bottom portion; and a laser device configured to irradiate the core-wire exposing portion with a laser beam through the holding-down jig from the sides of the free ends of the piece portions until the core-wire exposing portion is melted, and stop irradiation with the laser beam before the holding-down jig is removed after the core-wire exposing portion is melted by the laser beam.

According to still another aspect of the present invention, in the terminal-attached electric wire manufacturing apparatus, it is preferable that the holding-down jig has a laser passage portion that the laser beam emitted from the laser device passes through and that irradiates the core-wire exposing portion with the laser beam that has passed through the laser passage portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes in detail an embodiment of terminal-attached electric wire manufacturing method and apparatus according to the present invention, based on the drawings. This embodiment is not intended to limit this invention.

Embodiment

Based on FIG. 1 to FIG. 10, the following describes an embodiment of terminal-attached electric wire manufacturing method and apparatus according to the present invention.

Figure 1:
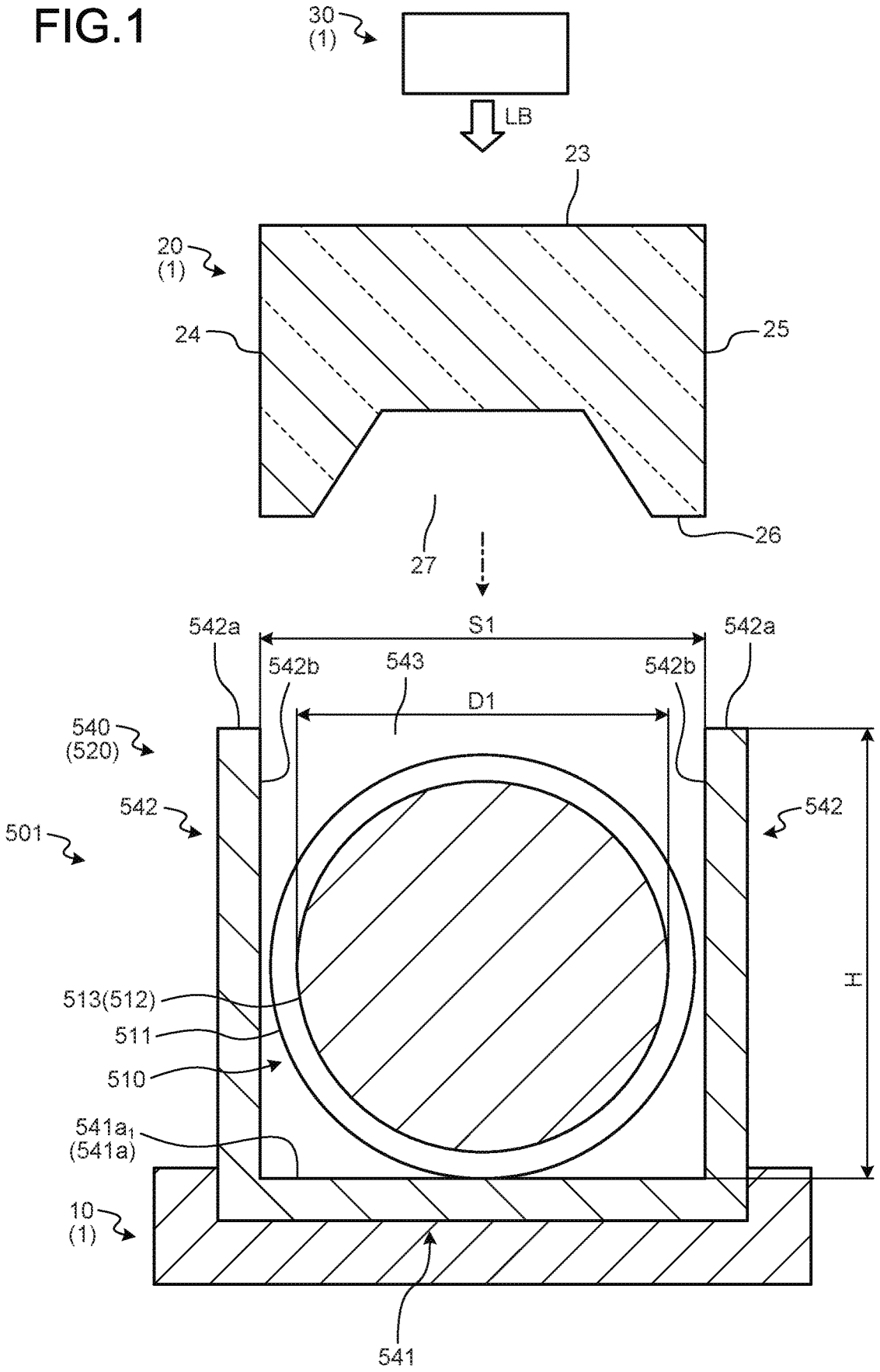
FIG. 1 illustrates a terminal-attached electric wire manufacturing apparatus in an embodiment.
Figure 2:
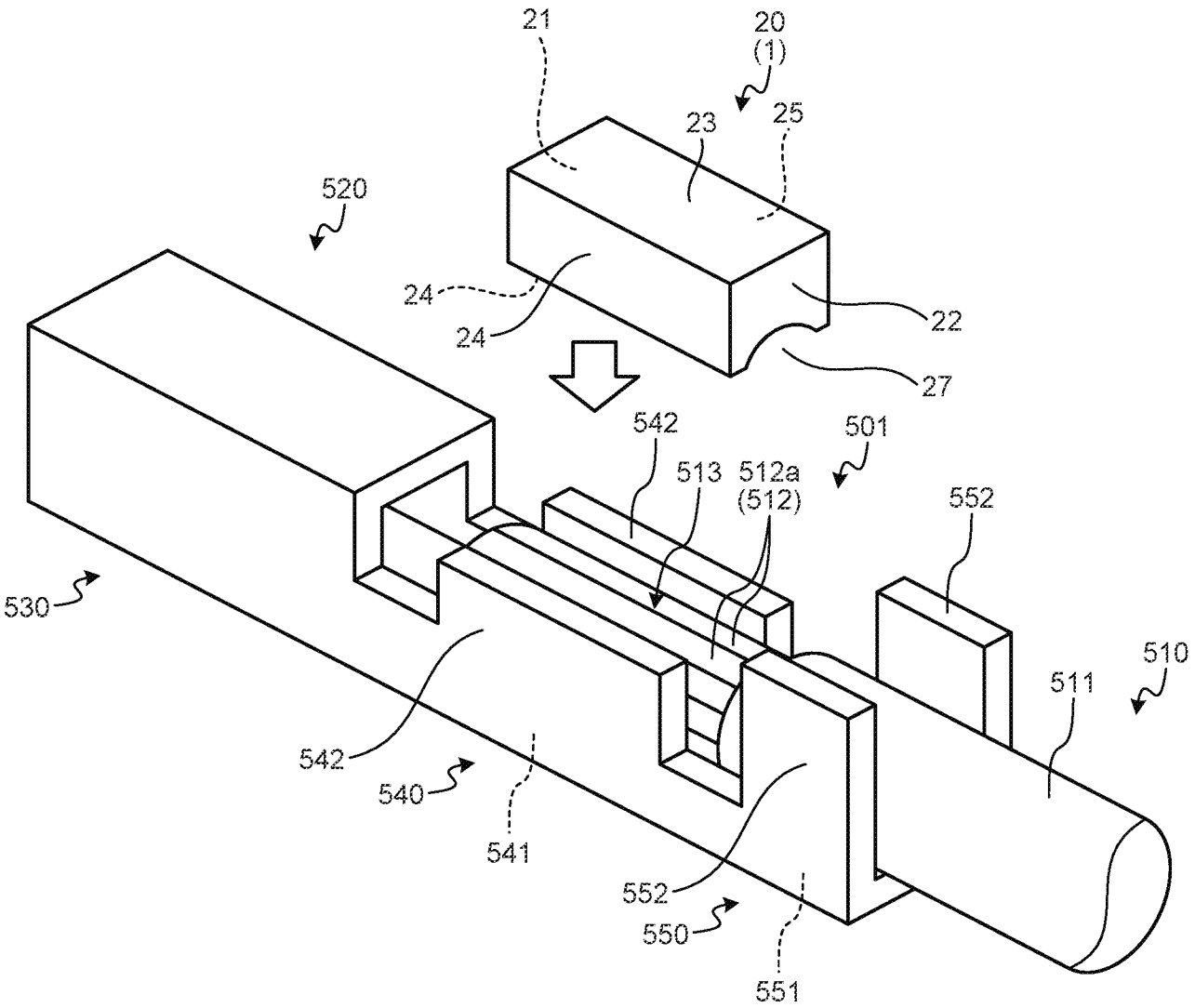
FIG. 2 is a perspective view illustrating a holding-down jig together with terminal-attached electric wire, depicting the state thereof before an electric-wire holding-down step.
Figure 3:
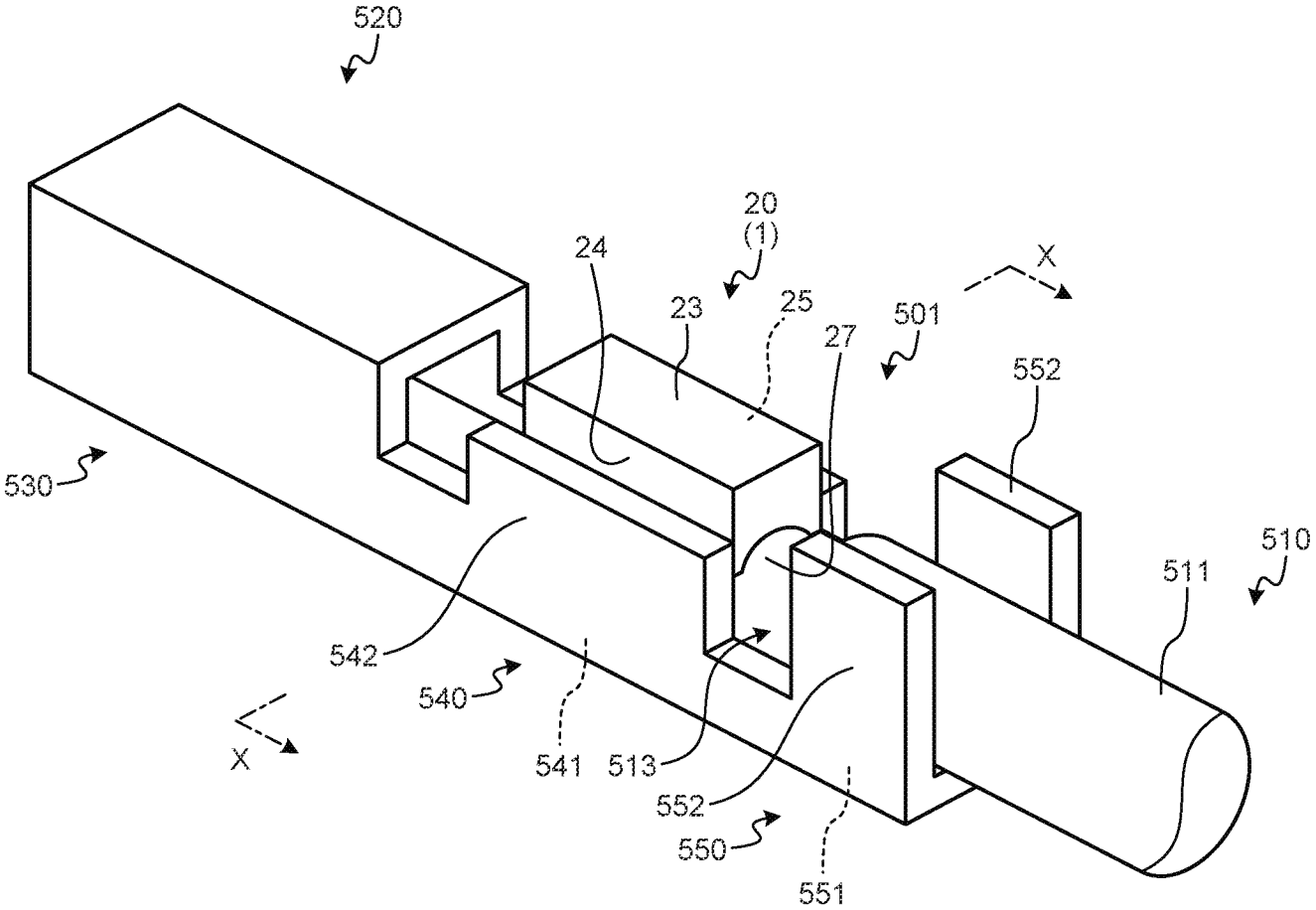
FIG. 3 is a perspective view illustrating the holding-down jig together with terminal-attached electric wire, depicting the state thereof after the electric-wire holding-down step.

Reference sign 1 in FIG. 1 to FIG. 3 indicates a terminal-attached electric wire manufacturing apparatus in the present embodiment. Reference sign 501 in FIG. 1 to FIG. 3 indicates a terminal-attached electric wire that is produced using the manufacturing apparatus 1 and a manufacturing method according to the manufacturing apparatus 1.

The terminal-attached electric wire 501 includes an electric wire 510 and a terminal fitting 520 that have been physically and electrically connected together (FIG. 1 to FIG. 3).

At a terminal end of the electric wire 510, a covering 511 is stripped off, so that a core wire 512 is exposed (FIG. 2). The core wire 512 is obtained by bundling a plurality of element wires 512*a*, each made of a wire member of electroconductive metal, into a circular columnar shape. However, the manufacturing method and apparatus 1 for the terminal-attached electric wire 501 described herein are not excluding an application of the electric wire 510 obtained by using a single rod-shaped conductor molded in a circular columnar shape as the core wire 512. In this electric wire 510, a portion from which the covering 511 is stripped off at the terminal end of the core wire 512 is referred to as a "core-wire exposing portion 513".

Figure 4:
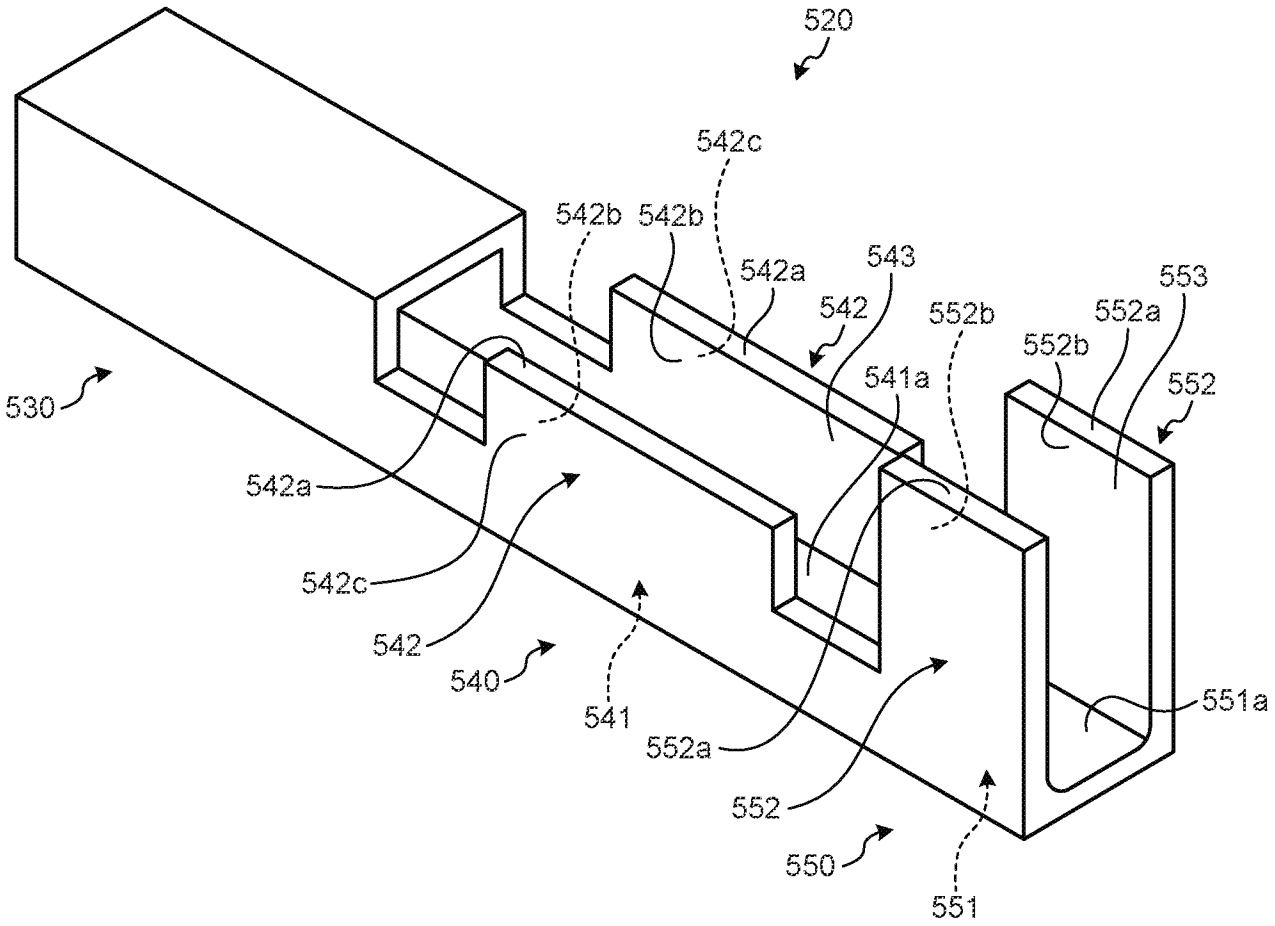
FIG. 4 is a perspective view illustrating a terminal fitting in the embodiment.

The terminal fitting 520 is obtained by molding a metal material such as a metal plate. This terminal fitting 520 includes: a terminal connector 530 that is physically and electrically connected to a terminal connector (not illustrated) of a counterpart terminal fitting; a core wire connector 540 that is physically and electrically connected to the core-wire exposing portion 513 at a terminal end of the electric wire 510; and a covering connector 550 that is physically connected to the covering 511 at a terminal end of the electric wire 510 (FIG. 2 to FIG. 4). In this terminal fitting 520, at least the core wire connector 540 and the covering connector 550 are serially arranged, and the terminal end of the electric wire 510 is connected to the core wire connector 540 and the covering connector 550 while having the axis line thereof extending in a direction of the serial arrangement, and the electric wire 510 is drawn out from the covering connector 550 in a direction in which the axis line extends. The term "axial direction" as used simply below unless otherwise stated shall mean the direction in which the core wire connector 540 and the covering connector 550 are serially arranged.

For example, while any one of the terminal connector 530 of the terminal fitting 520 and the terminal connector of the counterpart terminal fitting is formed in a female terminal shape, the other thereof is formed in a male terminal shape. Any one of these terminal connectors is inserted into and thereby engages the other thereof. For example, while the terminal connector 530 of the terminal fitting 520 is formed in a female terminal shape, the terminal connector of the counterpart terminal fitting is formed in a male terminal shape.

The core wire connector 540 is composed of a bottom portion 541 and a pair of piece portions 542, 542 projected from two opposite ends of this bottom portion 541 (FIG. 1 to FIG. 6). The core-wire exposing portion 513 is housed in a space surrounded by the bottom portion 541 and the pair of piece portions 542, 542. Before being connected to the core-wire exposing portion 513 (before being physically and electrically connected to the core-wire exposing portion 513), the core wire connector 540 described herein is shaped like a U-shaped plate composed of the bottom portion 541 and the pair of piece portions 542, 542. Unless otherwise stated below, a shape that the core wire connector 540 has before being physically and electrically connected to the core-wire exposing portion 513 is illustrated as the shape thereof.

In this core wire connector 540, for example, the core-wire exposing portion 513 is inserted between inner wall surfaces 542*b*, 542*b* through an opening 543 formed between respective free ends 542*a*, 542*a* of the piece portions 542, 542 (FIG. 1). The core-wire exposing portion 513 may stay above and at a distance from an inner wall surface (bottom surface) 541*a* of the bottom portion 541 because of the thickness of the covering 511 (FIG. 1) or may be mounted on the inner wall surface 541*a* of the bottom portion 541 due to the self-weight thereof. This core-wire exposing portion 513 is physically and electrically connected to the core wire connector 540 via the inner wall surface 541*a* of the bottom portion 541 and via the respective inner wall surfaces 542*b*, 542*b* of the piece portions 542, 542.

The respective piece portions 542, 542 are projected in the same direction from the two opposite ends of the bottom portion 541 and are arranged facing each other with the respective inner wall surfaces 542*b*, 542*b* thereof spaced from each other at a distance S1 (FIG. 1). In the core wire connector 540 described herein, the bottom portion 541 and the pair of piece portions 542, 542 are shaped in rectangular flat plates and in the same plate thickness. The term "width direction" as used simply below unless otherwise stated shall mean the direction in which the pair of piece portions 542, 542 are arranged facing each other.

The covering connector 550 is composed of a barrel bottom portion 551 and a pair of barrel piece portions 552, 552 projected from two opposite ends of this barrel bottom portion 551 (FIG. 2 to FIG. 4). Before being connected to the covering 511 at the terminal end of the electric wire 510 (before being physically connected to the covering 511 at the terminal end of the electric wire 510), this covering connector 550 is shaped like a U-shaped plate composed of the barrel bottom portion 551 and the pair of barrel piece portions 552, 552. In this covering connector 550, for example, a portion of the covering 511 at the terminal end of the electric wire 510 is inserted inward through an opening 553 formed between respective free ends 552*a*, 552*a* of the barrel piece portions 552, 552 and the portion of the covering 511 is mounted on an inner wall surface (bottom surface) 551*a* of the barrel bottom portion 551. The covering 511 at the terminal end of the electric wire 510 is physically connected to the covering connector 550 via the inner wall surface 551*a* of the barrel bottom portion 551 and via the respective inner wall surfaces 552*b*, 552*b* of the barrel piece portions 552, 552.

The respective barrel piece portions 552, 552 are projected in the same direction from the two opposite ends of the barrel bottom portion 551 and are arranged facing each other with the respective inner wall surfaces 552*b*, 552*b* thereof spaced from each other at a distance. In the covering connector 550 described herein, the barrel bottom portion 551 and the pair of barrel piece portions 552, 552 are shaped in rectangular flat plates and in the same plate thickness.

Figure 6:
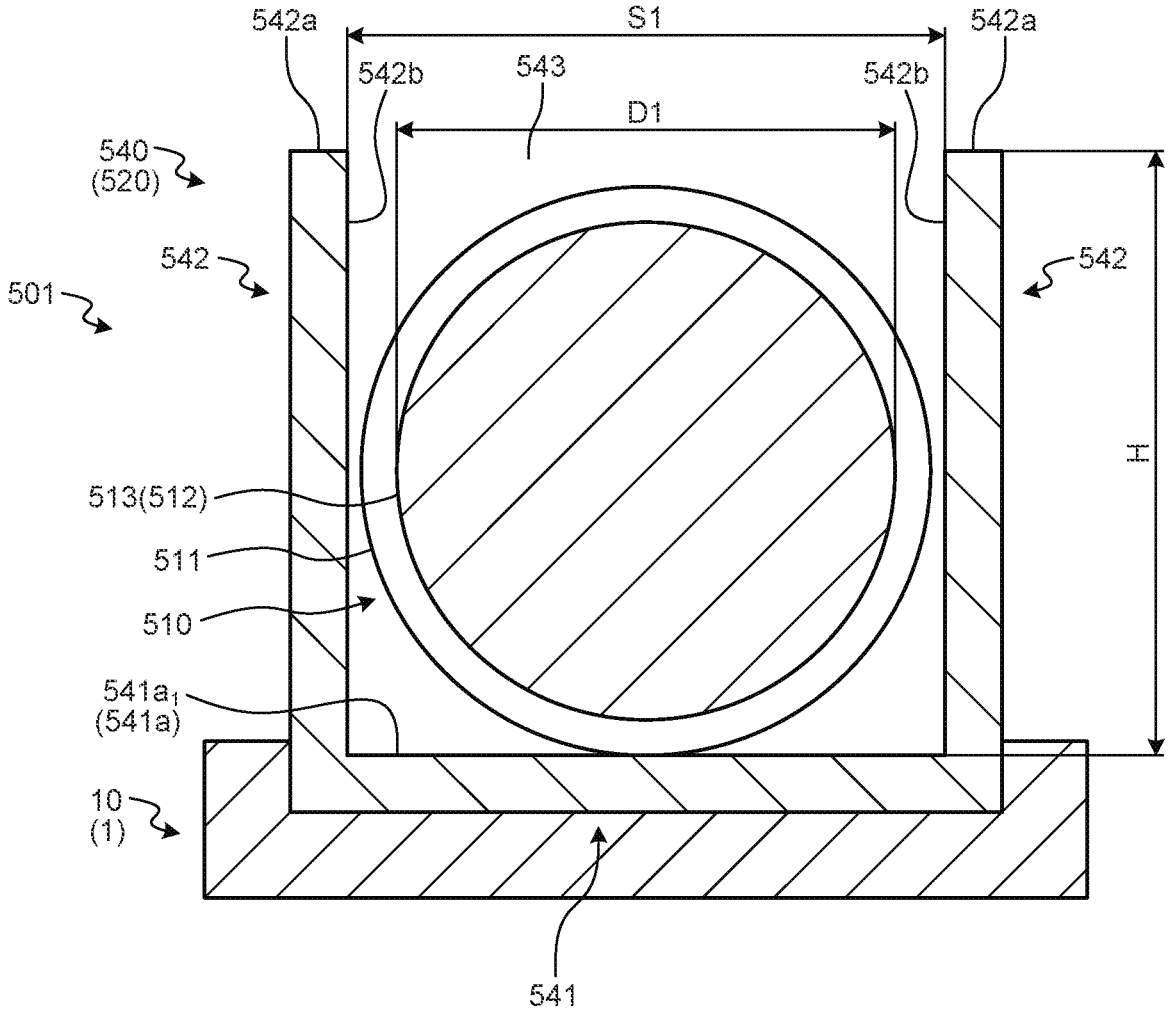
FIG. 6 is a view corresponding to a section taken along the X-X line of FIG. 3, depicting a state after an electric-wire placing step is performed.
Figure 7:
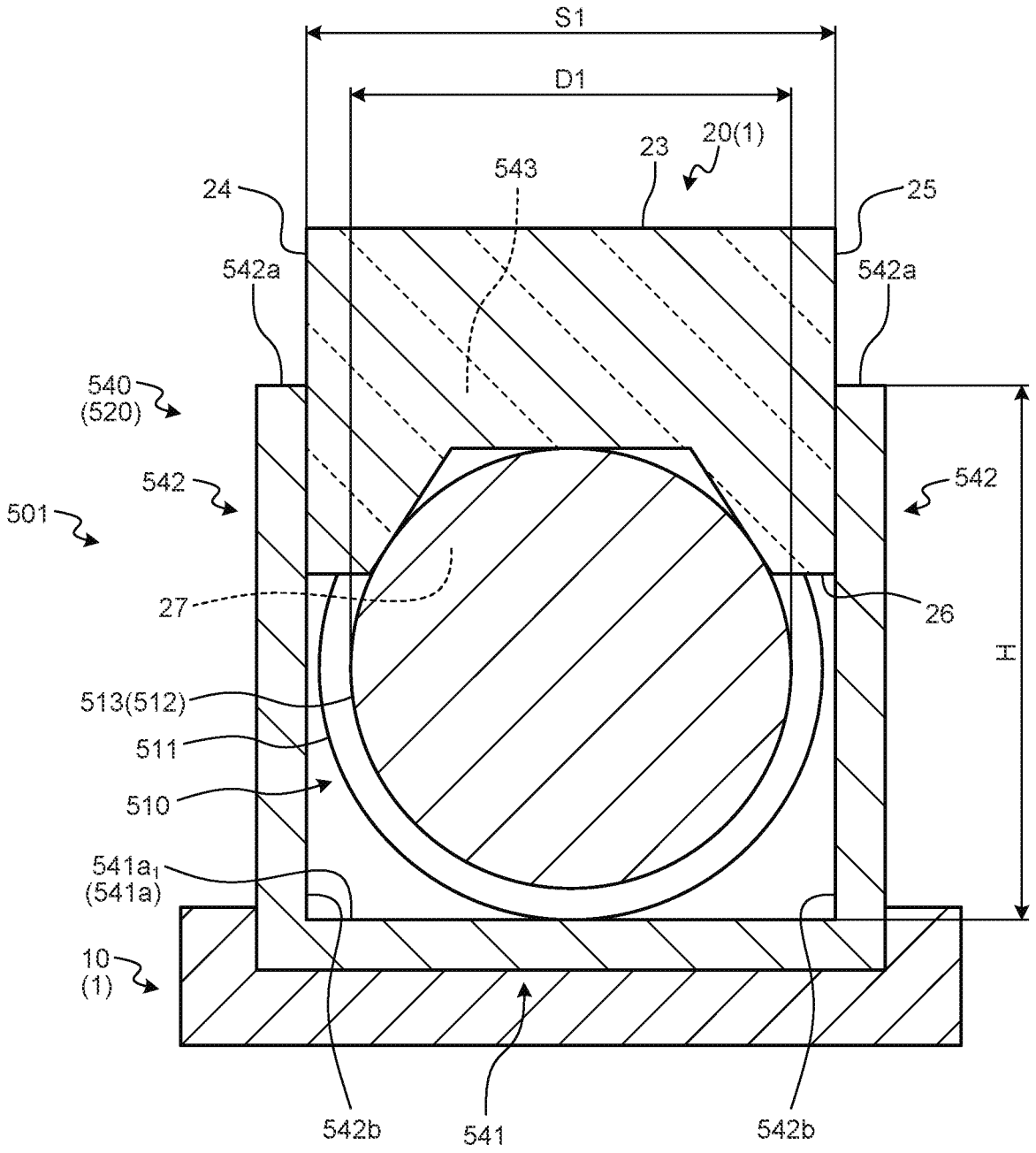
FIG. 7 is a sectional view taken along the X-X line of FIG. 3.

A core wire diameter D1 of the electric wire 510 that this terminal fitting 520 can be connected to may have: a size such that the core-wire exposing portion 513 can be completely housed inside a space surrounded by the bottom portion 541 and the pair of piece portions 542, 542; or a size such that the core-wire exposing portion 513 cannot be completely housed inside the space. However, so that operation of holding down the core-wire exposing portion 513 using a holding-down jig 20 described below can be facilitated, the core wire diameter D1 of the electric wire 510 that the terminal fitting 520 described herein is connected to is smaller than a projection height H by which the piece portions 542, 542 are projected from a lowermost surface 541$a_1$ of the bottom portion 541 (FIG. 1 and FIG. 6). That is, the terminal fitting 520 described herein is connected to the electric wire 510 having a size such that the core-wire exposing portion 513 can be completely housed inside the foregoing space. The lowermost surface 541$a_1$ of the bottom portion 541 refers to a portion that is, within the inner wall surface 541*a* of the bottom portion 541, the most distant from the opening 543 formed between the respective free ends 542*a*, 542*a* of the piece portions 542, 542. In the case of the bottom portion 541 described herein, the inner wall surface 541*a* itself corresponds to the lowermost surface 541$a_1$. The core wire connector 540 is shaped in such a manner that the projection height H of the piece portions 542, 542 from the lowermost surface 541$a_1$ of the bottom portion 541 is larger than the core wire diameter D1 of the core-wire exposing portion 513. In addition, conditions for the electric wire 510 that the terminal fitting 520 can be connected to include, in addition to the condition relating to the projection height H, that the core wire diameter D1 is equal to or smaller than the distance S1 between the respective inner wall surfaces 542*b*, 542*b* of the piece portions 542, 542. Thus, the core wire connector 540 is shaped in such a manner that the distance S1 between the respective inner wall surfaces 542*b*, 542*b* of the piece portions 542, 542 is equal to or larger than the core wire diameter D1 in the core-wire exposing portion 513.

When the electric wire 510 and terminal fitting 520 are assembled together into this terminal-attached electric wire 501, the terminal fitting 520 is mounted on the terminal mount 10 (FIG. 5), and the terminal end of the electric wire 510 is then placed on the core wire connector 540 and the covering connector 550 of the terminal fitting 520 (FIG. 6). Thus, the terminal mount 10 serves as a constituent element of the manufacturing apparatus 1 for the terminal-attached electric wire 501. In addition, the manufacturing method for this terminal-attached electric wire 501 includes a terminal placing step of mounting the terminal fitting 520 on the terminal mount 10 and an electric-wire placing step of placing the terminal end of the electric wire 510 on the core wire connector 540 and the covering connector 550.

Figure 5:
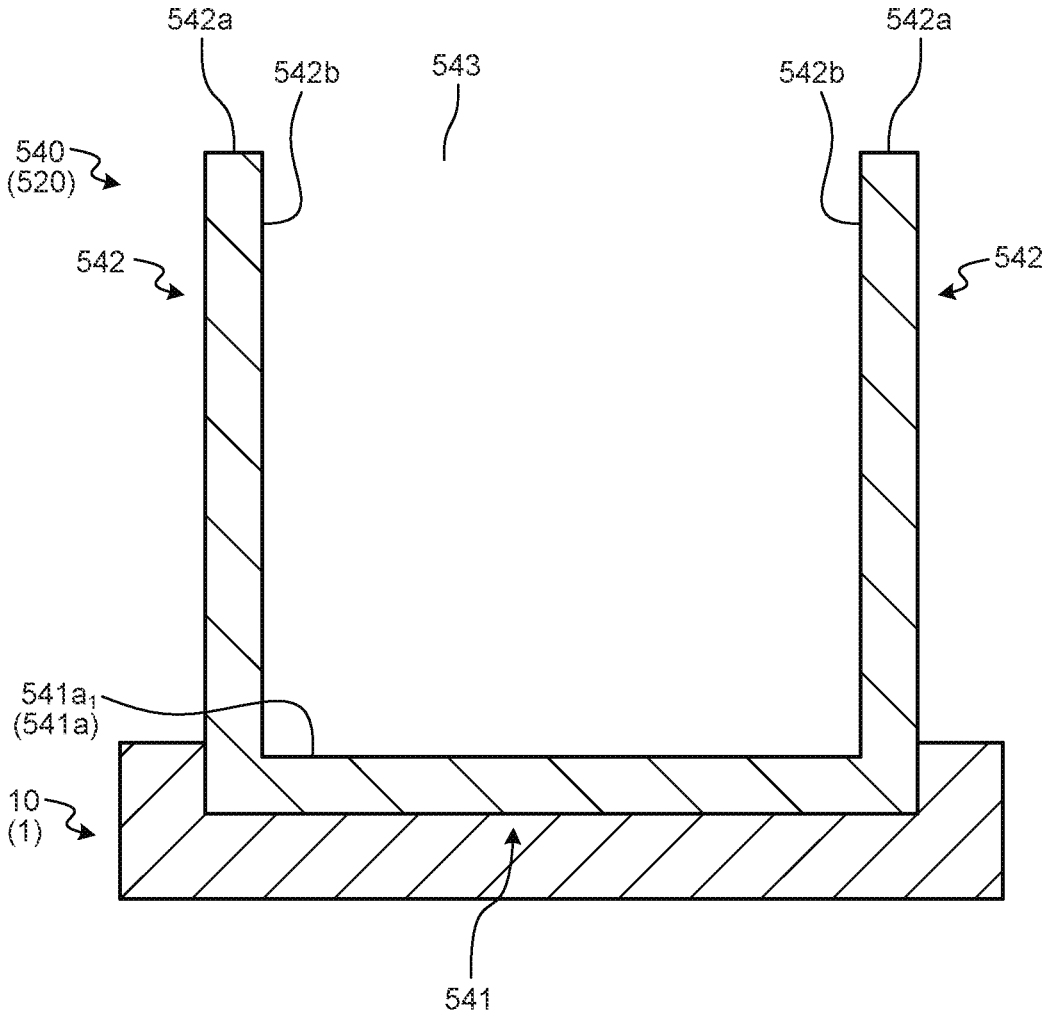
FIG. 5 is a view corresponding to a section taken along the X-X line of FIG. 3, depicting a state with a terminal mount after a terminal placing step is performed.

The terminal mount 10 may be a jig on which the bottom portion 541 of the core wire connector 540 and the barrel bottom portion 551 of the covering connector 550 are mounted, and be a synthetic resin housing (not illustrated), such as a container, inside which the terminal fitting 520 is contained. In this embodiment, the terminal mount 10 that serves as the foregoing jig is given as an example. At the terminal placing step, for example, the terminal fitting 520 fed from a feeder (not illustrated) is mounted on the terminal mount 10 (FIG. 5).

At the electric-wire placing step, the core-wire exposing portion 513 is inserted between the respective inner wall surfaces 542*b*, 542 of the piece portions 542, 542 in the core wire connector 540 (FIG. 6). At the electric-wire placing step described herein, the core-wire exposing portion 513 the core wire diameter D1 of which is smaller than the respective projection heights H of the piece portions 542, 542.

The electric-wire placing step described herein is carried by a worker using his or her hands. Consequently, the manufacturing apparatus 1 described herein is not provided with an electric-wire placement apparatus for placing the terminal end of the electric wire 510 on the core wire connector 540 and on the covering connector 550. Such an electric-wire placement apparatus is, for example, provided with, together with a controller that controls operation of the device, a device (such as an arm) configured to hold the electric wire 510 and deliver the terminal end thereof to the core wire connector 540 and the covering connector 550. Thus, so that the electric-wire placing step can be performed without the need for troublesome manual handling by a worker, the manufacturing apparatus 1 may include such an electric-wire placement apparatus as a constituent element thereof.

At the electric-wire placing step, the core-wire exposing portion 513 composed of the element wires 512*a* is inserted between the respective inner wall surfaces 542*b*, 542*b* of the piece portions 542, 542. Thus, at the electric-wire placing step, the core-wire exposing portion 513 is inserted into the inside of the core wire connector 540 in such a manner that the element wires 512*a* do not unravel.

Furthermore, at the electric-wire placing step described herein, when the core-wire exposing portion 513 is inserted between the respective inner wall surfaces 542*b*, 542*b* of the piece portions 542, 542, the covering 511 at the terminal end of the electric wire 510 is inserted between the respective inner wall surfaces 552*b*, 552*b* of the barrel piece portions 552, 552 to be mounted on the inner wall surface 551*a* of the barrel bottom portion 551.

In the terminal fitting 520 described herein, the inner wall surface 541*a* of the bottom portion 541 of the core wire connector 540 is flush with the inner wall surface 551*a* of the barrel bottom portion 551 of the covering connector 550. Consequently, at the electric-wire placing step, depending on the length and the weight of the core-wire exposing portion 513, the core-wire exposing portion 513 may stay above and at a distance from the inner wall surface 541*a* of the bottom portion 541, the distance being at least equal to or larger than the thickness of the covering 511. In this example, for explanatory convenience, the core-wire exposing portion 513 is placed above and at a distance from the inner wall surface 541*a* of the bottom portion 541.

In this terminal-attached electric wire 501, when the electric wire 510 and the terminal fitting 520 are assembled together, a holding-down jig 20 is used to hold down the core-wire exposing portion 513 in order to maintain a state in which the core-wire exposing portion 513 has been inserted in the inside of the core wire connector 540 at the electric-wire placing step in such a manner that the element wires 512*a* are kept from unraveling (FIG. 1 to FIG. 3 and FIG. 7). Thus, the holding-down jig 20 serves as a constituent element of the manufacturing apparatus 1 for the terminal-attached electric wire 501. The manufacturing method for this terminal-attached electric wire 501 includes an electric-wire holding-down step in which the holding-down jig 20 is used to hold down the core-wire exposing portion 513 from the free ends 542*a*, 542*a* of the piece portions 542, 542 and press the core-wire exposing portion 513 against the inner wall surface 541*a* of the bottom portion 541.

The holding-down jig 20 may be configured to hold down the core-wire exposing portion 513 via wall surfaces thereof or may be configured to hold down the core-wire exposing portion 513 via terminal surfaces of wall bodies thereof.

For example, the holding-down jig 20 is molded in a rectangular cuboid shape. Thus, the holding-down jig 20 has: a first wall surface 21 corresponding to one end side of the piece portions 542, 542 in the axial direction; and a second wall surface 22 corresponding to the other end side of the piece portions 542, 542 in the axial direction (FIG. 2). This holding-down jig 20 further includes a third wall surface 23, a fourth wall surface 24, a fifth wall surface 25, and a sixth wall surface 26 (FIG. 2). The third wall surface 23 links the first wall surface 21 and the second wall surface 22 together on one side of the holding-down jig 20 that faces away from the core-wire exposing portion 513. The fourth wall surface 24 links the first wall surface 21 and the second wall surface 22 together on one side of the holding-down jig 20 that corresponds to one of the piece portions 542, 542. The fifth wall surface 25 links the first wall surface 21 and the second wall surface 22 on another side of the holding-down jig 20 that corresponds to the other one of the piece portions 542, 542. The sixth wall surface 26 links the first wall surface 21 and the second wall surface 22 on still another side of the holding-down jig 20 that faces the core-wire exposing portion 513.

The holding-down jig 20 is configured to hold down the core-wire exposing portion 513 via the sixth wall surface 26. Specifically, with a groove portion 27 formed in the holding-down jig 20 so as to extend in the axial direction by denting the sixth wall surface 26, the holding-down jig 20 holds down a portion of the core-wire exposing portion 513 via a wall surface thereof that corresponds to the groove bottom of the groove portion 27 and via two side wall surfaces thereof, the portion facing the opening 543 (FIG. 1 to FIG. 3 and FIG. 7). The groove portion 27 described herein has, in a section perpendicular to a direction in which the groove portion 27 extends, a trapezoidal shape the upper base of which faces the groove bottom.

This holding-down jig 20 is inserted between the pair of piece portions 542, 542 through the opening 543. Consequently, at the electric-wire holding-down step, the insertion of the holding-down jig 20 between the pair of piece portions 542, 542 through the opening 543 causes the core-wire exposing portion 513 to: be held down by the groove portion 27 of the holding-down jig 20; and be pressed against the inner wall surface 541*a* of the bottom portion 541 by the groove portion 27 of the holding-down jig 20.

For example, this holding-down jig 20 is formed in such a manner that a length from the first wall surface 21 to the second wall surface 22 is at least equal to or larger than the respective lengths of the piece portions 542, 542 in the axial direction. The holding-down jig 20 described herein is formed in such a manner that the length is equal to the respective lengths of the piece portions 542, 542 in the axial direction. Furthermore, the holding-down jig 20 described herein is formed in such a manner that a length (the width thereof) from the fourth wall surface 24 to the fifth wall surface 25 is equal to the distance S1 between the respective inner wall surfaces 542*b*, 542*b* of the piece portions 542, 542. Thus, the fourth wall surface 24 of the holding-down jig 20 is caught and stopped by one of the piece portions 542, 542 while the fifth wall surface 25 thereof is caught and stopped by the other one of the piece portions 542, 542. Consequently, the core-wire exposing portion 513 is prevented from rotate about the axis of and relative to the core wire connector 540.

A member molded out of a laser-transmissive material the melting point of which is higher than the melting points of the core-wire exposing portion 513 and the core wire connector 540 is used as this holding-down jig 20. The laser-transmissive material means a material the melting point characteristic of which is as described above and the transmittance of which is larger the sum of the absorptance and the reflectance thereof for a laser beam.

For example, herein, the element wires 512*a* of the core-wire exposing portion 513 are molded out of aluminum or aluminum alloy, and the core wire connector 540 is molded out of copper and copper alloy. For this reason, the holding-down jig 20 molded out of a laser-transmissive material having a higher melting point than the above materials. Specifically, when an infrared laser is used, a material that transmits an infrared region (for example, has a transmittance of 90% or higher) while having such a melting point characteristic is used as the laser-transmissive material. Specifically, when an ultraviolet laser is used, a material that transmits an ultraviolet region (for example, has a transmittance of 90% or higher) while having such a melting point characteristic is used as the laser-transmissive material. To be more specific, a laser-transmissive material made of quartz glass or fluoride glass, which represents non-quartz based glass, may be used as a material that satisfies all of these requirements. When an infrared laser is used, a laser-transmissive material made of chalcogenide glass may be used alternatively.

In this terminal-attached electric wire 501, the core-wire exposing portion 513 and the core wire connector 540 are welded together with the core-wire exposing portion 513 held down by the holding-down jig 20. Thus, the manufacturing method for this terminal-attached electric wire 501 includes a melting step and a fixing step, in which the core-wire exposing portion 513 and the core wire connector 540 are welded together. In addition, the covering 511 at the terminal end of the electric wire 510 and the covering connector 550 are pressure-bonded together in this terminal-attached electric wire 501. Thus, the manufacturing method for this terminal-attached electric wire 501 includes a pressure-bonding step in which these members are pressure-bonded together.

In this manufacturing method, the orders of the melting step, the fixing step, and the pressure-bonding step may be changed. For example, at the pressure-bonding step, the portion that corresponds to the covering 511 at the terminal end of the electric wire 510 stretches in the direction of the axis line thereof when the covering connector 550 is swaged and pressure-bonded to the covering 511 at the terminal end of the electric wire 510. For this reason, in consideration of the stretching of the electric wire 510, the melting step and the fixing step may be performed after the pressure-bonding step in this manufacturing method. In this terminal-attached electric wire 501, the electric wire 510 is drawn outward from the covering connector 550 in the direction of the axis line. Consequently, the portion corresponding to the covering 511 at the terminal end can be stretched at the pressure-bonding step in a direction in which the electric wire 510 is drawn. Thus, in this manufacturing method, the pressure-bonding step is performed after the melting step and the fixing step are performed.

Figure 8:
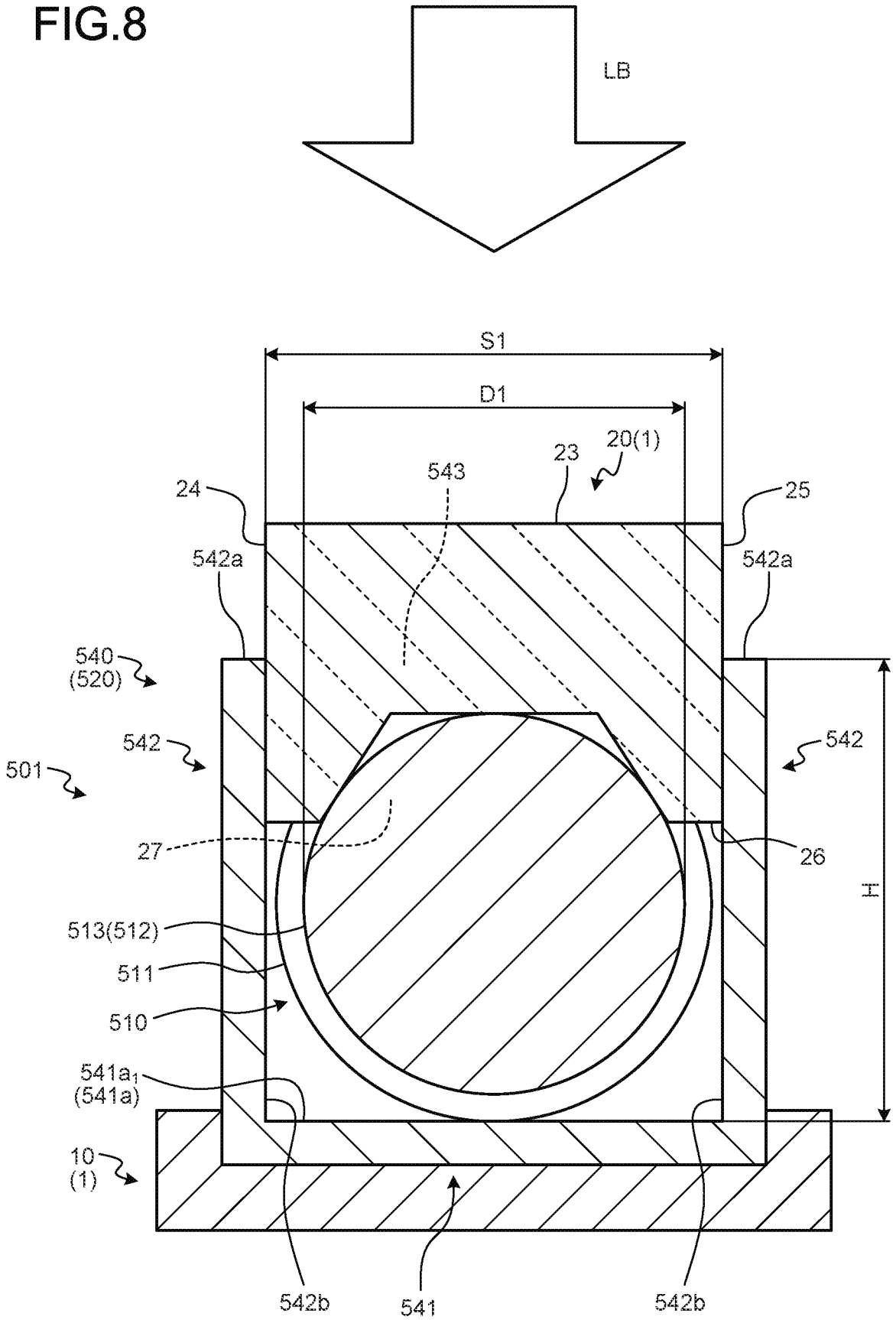
FIG. 8 is a view corresponding to a section taken along the X-X line of FIG. 3, depicting a state before a core-wire exposing portion is melt at a melting step.

At the melting step, a laser device 30 is controlled to radiate a laser beam LB from the laser device 30 toward the holding-down jig 20, so that the core-wire exposing portion 513 is irradiated with the laser beam LB that has been transmitted by the holding-down jig 20 (FIG. 1 and FIG. 8). The laser beam LB is radiated in a width that is equal to or smaller in the width direction than the core wire diameter D1 of the core-wire exposing portion 513 (FIG. 8).

At the melting step, the core-wire exposing portion 513 is irradiated with the laser beam LB with the holding-down jig 20 from one side of the piece portions 542, 542 that has the respective free ends 542*a*, 542*a* until the core-wire exposing portion 513 is melted. Melting of the core-wire exposing portion 513 starts from a portion thereof irradiated with the laser beam LB. At this melting step, the laser beam LB is swept, for example, from the first wall surface 21 side of the holding-down jig 20 to the second wall surface 22 side thereof.

Figure 9:
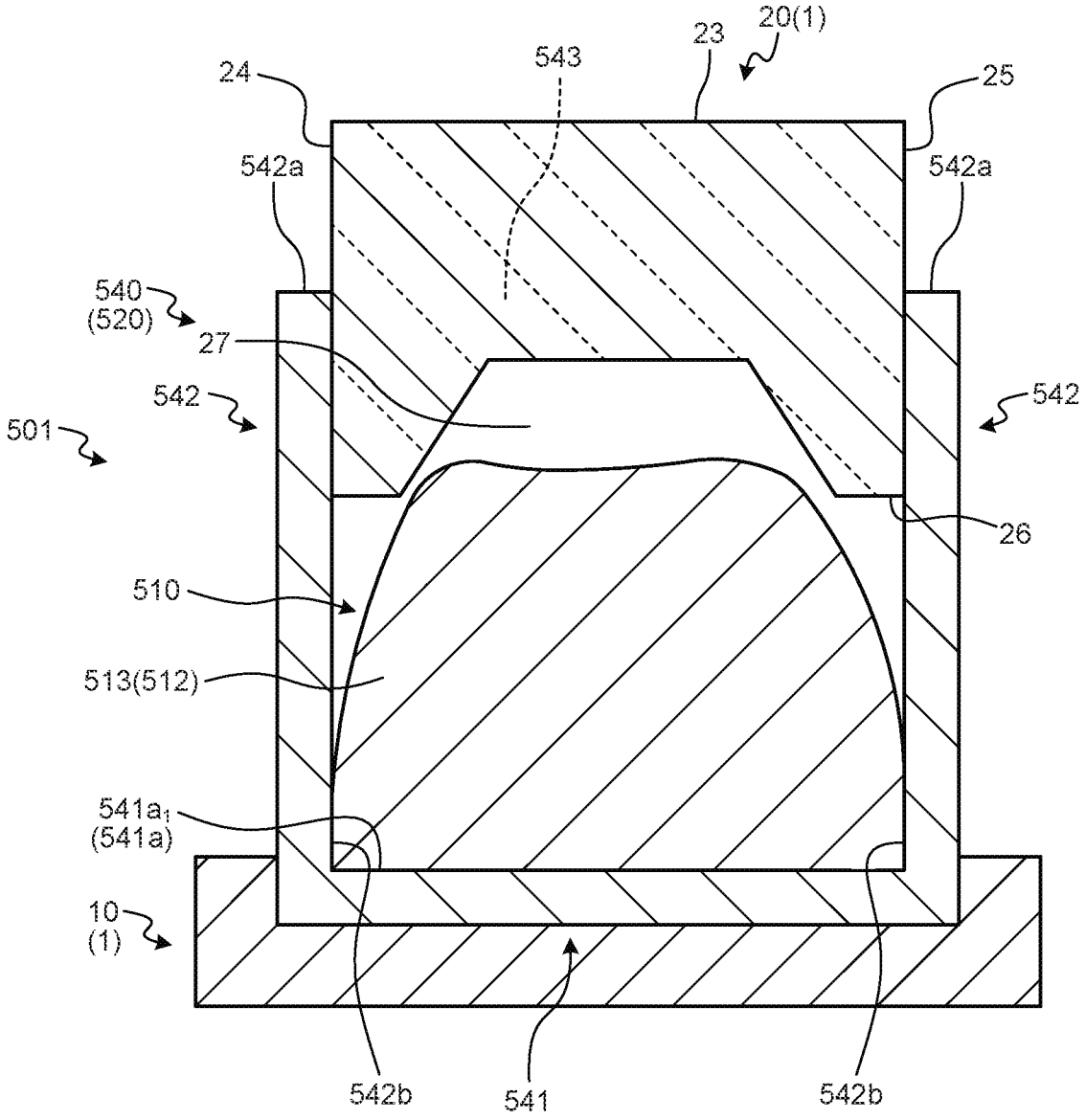
FIG. 9 is a view corresponding to a section taken along the X-X line of FIG. 3, depicting a state after the core-wire exposing portion is melt at the melting step and before the holding-down jig is detached at a fixing step.
Figure 10:
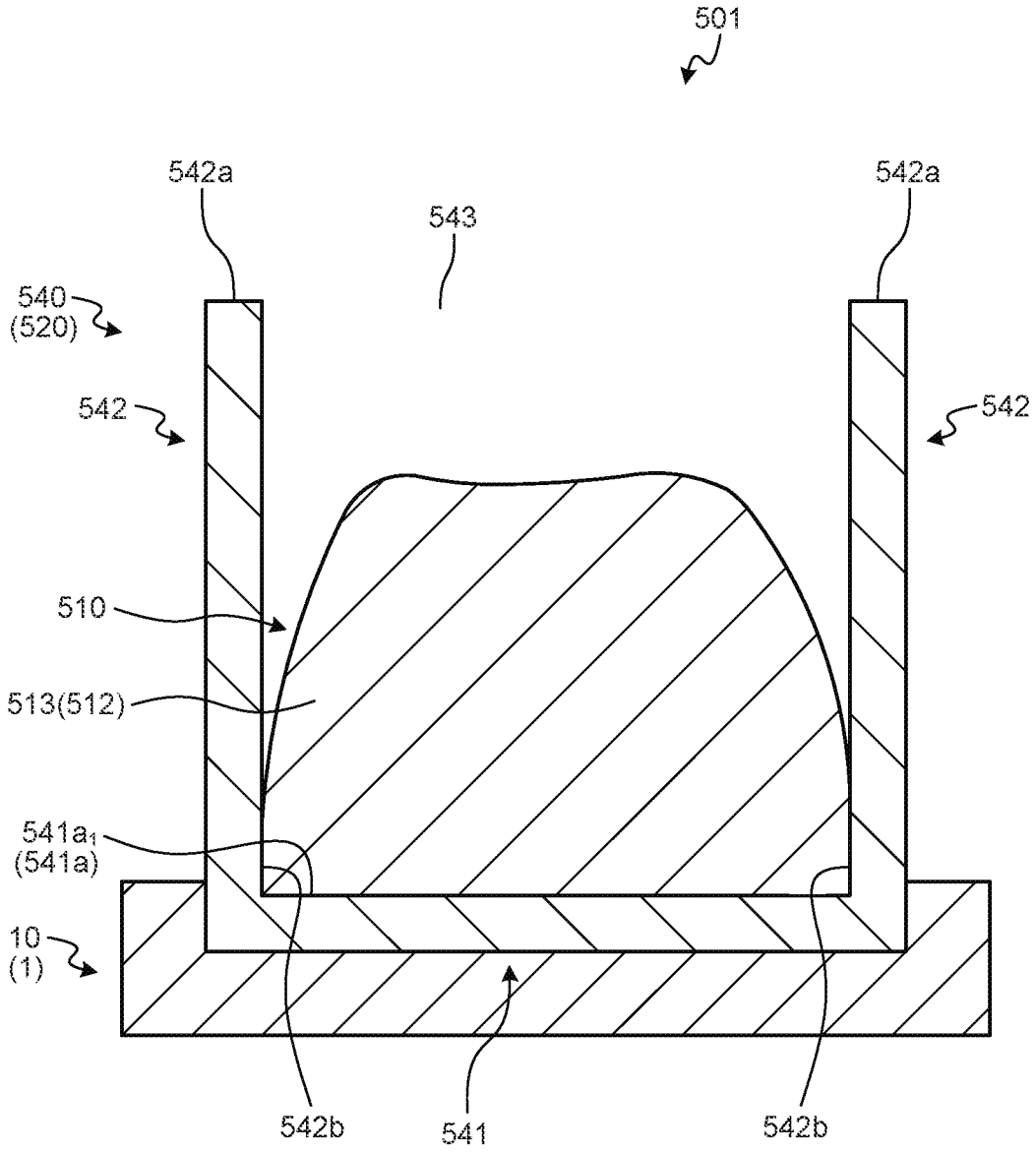
FIG. 10 is a view corresponding to a section taken along the X-X line of FIG. 3, depicting a state after the fixing step is performed.

In this manufacturing method, the melting step is ended once the core-wire exposing portion 513 between the piece portions 542, 542 is completely melted, and the fixing step is then started (FIG. 9). At this fixing step, the laser device 30 is controlled to stop radiation of the laser beam LB from the laser device 30, and the holding-down jig 20 is removed from the terminal fitting 520. That is, at the fixing step, radiation of the laser beam LB is stopped before the holding-down jig 20 is removed after the core-wire exposing portion 513 is melted. As a result, at the fixing step, the core-wire exposing portion 513 can be bonded to the core wire connector 540 by solidifying the core-wire exposing portion 513 that has been melted by the laser beam LB (FIG. 10).

At the pressure-bonding step, a pressure-bonding machine (not illustrated) having a configuration that is publicly known in this technical field is used. At this pressure-bonding step, the covering connector 550 that has the covering 511 at the terminal end of the electric wire 510 housed therein is sandwiched between an upper mold and a lower mold of the pressure-bonding machine, and pressure is then applied to the covering connector 550. The respective barrel piece portions 552, 552 are thereby wrapped around the covering 511 of the terminal end of the electric wire 510, for example, in such a manner as to follow the shape of the upper mold.

As described above, the manufacturing method and apparatus 1 for the terminal-attached electric wire 501 in the present embodiment causes the core-wire exposing portion 513 to be held down by the holding-down jig 20 before the melting step. Therefore, when the core-wire exposing portion 513 is composed of the two or more element wires 512*a*, the element wires 512*a* in the core-wire exposing portion 513 do not unravel, whereby the core-wire exposing portion 513 can be irradiated with the laser beam LB without the element wires 512*a* hanging out of the core wire connector 540. That is, these manufacturing method and apparatus 1 for this terminal-attached electric wire 501 can, by use of the holding-down jig 20, prevent unraveling of the element wires 512*a* without the need of providing the terminal fitting 520 with any device for preventing unraveling of the element wires 512*a* and thus melt the core-wire exposing portion 513 with the laser beam LB in that state. Thus, these manufacturing method and apparatus 1 for the terminal-attached electric wire 501 can, for example, prevent the element wires 512*a* from being melted and cut when the laser beam LB is radiated. Therefore, these manufacturing method and apparatus 1 for the terminal-attached electric wire 501 can provide enhanced conduction quality between the electric wire 510 and the terminal fitting 520 by making the connection between the core-wire exposing portion 513 and the core wire connector 540 favorable and stable even when the terminal fitting 520 does not include a device for preventing unraveling of the element wires 512*a*. In addition, these manufacturing method and apparatus 1 for the terminal-attached electric wire 501 are excellent in versatility because, for example, an existing fitting can be used for the terminal fitting 520.

Moreover, for example, when the holding-down jig 20 is molded out of quartz glass as a raw material, these manufacturing method and apparatus 1 for the terminal-attached electric wire 501 allow efficient use of heat generated by the laser beam LB because, due to the low thermal conductivity of the holding-down jig 20, the holding-down jig 20 takes in only a small amount of heat when transmitting the laser beam LB. Thus, these manufacturing method and apparatus 1 for the terminal-attached electric wire 501 allows the output of the laser beam LB to be low as compared with a case in which a holding-down jig made of a material that can transmit the laser beam LB and has a high thermal conductivity is used.

Furthermore, these manufacturing method and apparatus 1 for the terminal-attached electric wire 501 can reduce the impact of heat on the covering 511 because only the core-wire exposing portion 513 is irradiated with the laser beam LB.

Modification 1

Figure 11:
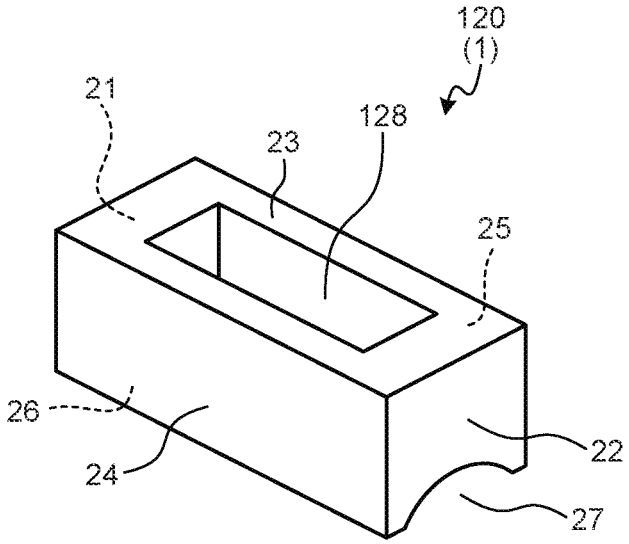
FIG. 11 is a perspective view illustrating a holding-down jig in a first modification.
Figure 12:
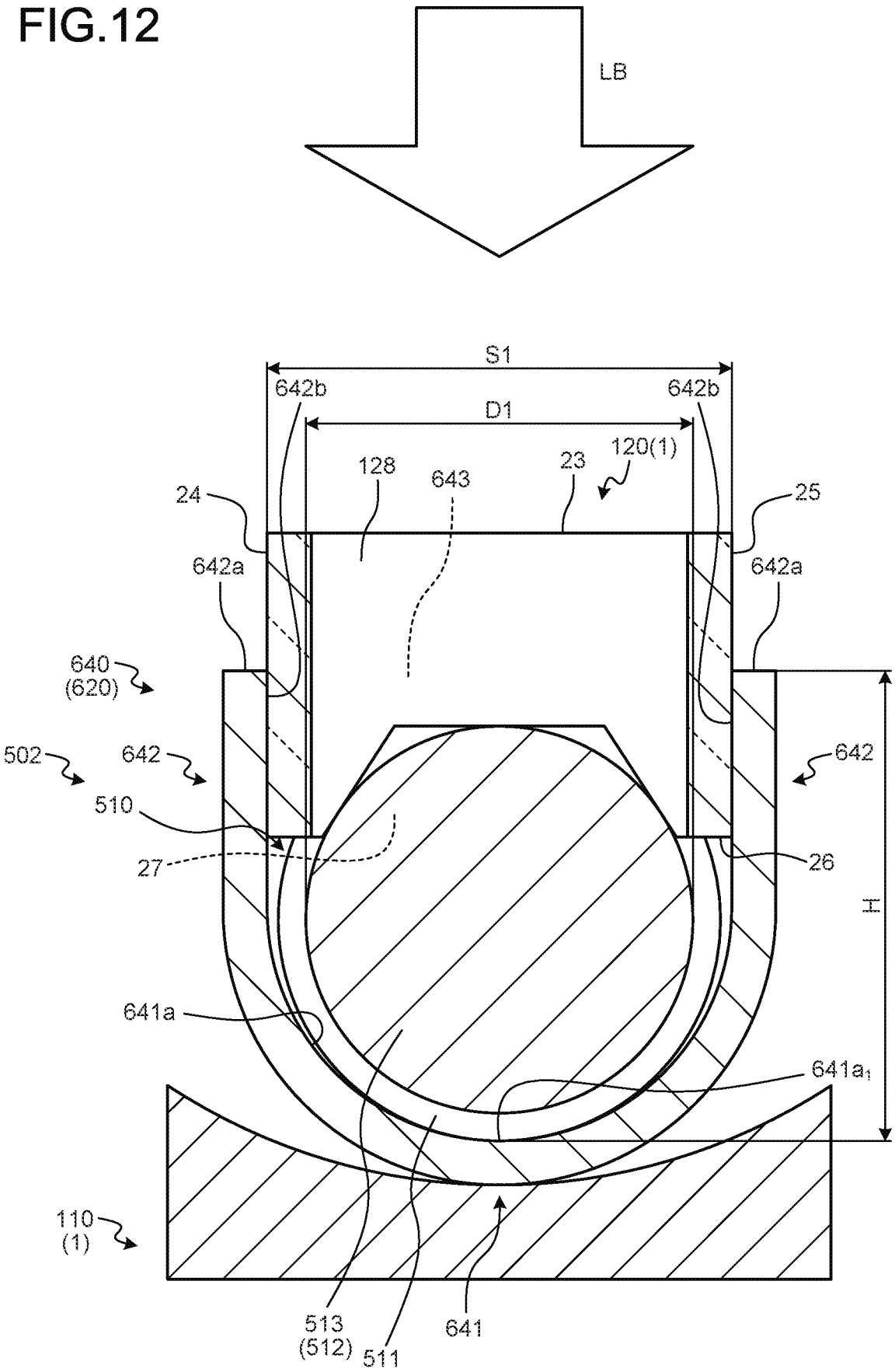
FIG. 12 is an explanatory view illustrating a state before a core-wire exposing portion is melted at a melting step in the first modification.
Figure 13:
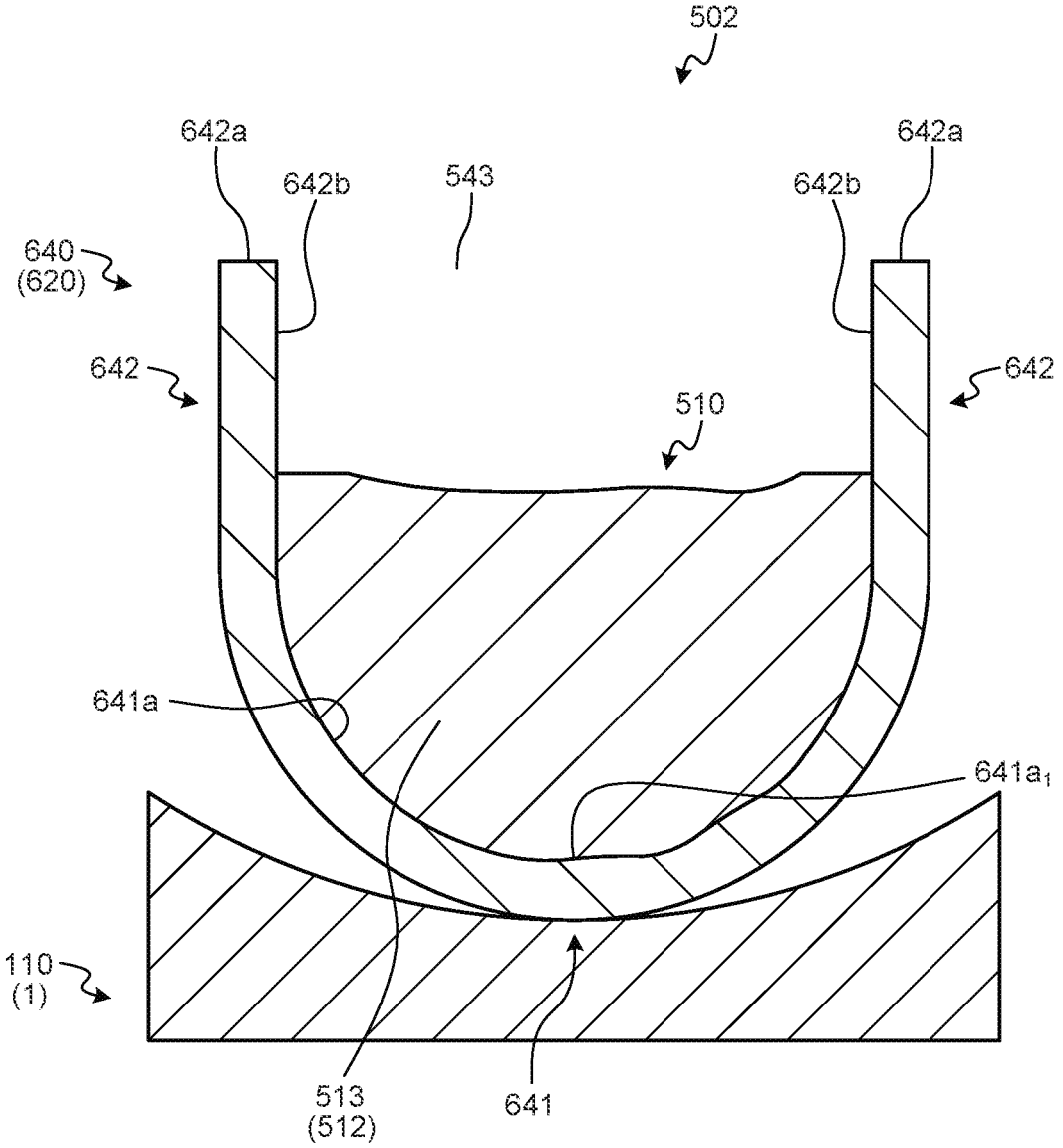
FIG. 13 is an explanatory view illustrating a state before a fixing step in the first modification.

A manufacturing method and a manufacturing apparatus 1 for a terminal-attached electric wire in the present modification are obtained by replacing the holding-down jig 20 with a holding-down jig 120 described below (FIG. 11 and FIG. 12) in the manufacturing method and apparatus 1 for a terminal-attached electric wire in the aforementioned embodiment. The holding-down jig 120 is usable also for producing the terminal-attached electric wire 501 in the aforementioned embodiment. However, in this modification, this holding-down jig 120 is applied to a terminal fitting 620 described below (FIG. 12). That is, the manufacturing method and apparatus 1 for a terminal-attached electric wire in the present modification produce a terminal-attached electric wire 502 obtained by attaching the terminal fitting 620 to a terminal end of the electric wire 510 is produced (FIG. 12). Thus, a terminal mount 110 in the present modification is a replacement that follows the shape of the terminal fitting 620 (FIG. 12 and FIG. 13).

The terminal fitting 620 in the present modification is substantially equivalent to one obtained by, for example, replacing at least the core wire connector 540 in the terminal fitting 520 in the aforementioned embodiment with the core wire connector 640 described below (FIG. 12). The core wire connector 640 is composed of an arc-shaped bottom portion 641 and a pair of piece portions 642, 642 projected from two opposite ends of this bottom portion 641. Before being connected to the core-wire exposing portion 513 (before being physically and electrically connected to the core-wire exposing portion 513), this core wire connector 640 is shaped like a U-shaped plate composed of the bottom portion 641 and a pair of piece portions 642, 642. Unless otherwise stated below, a shape that the core wire connector 640 has before being connected to the core-wire exposing portion 513 is illustrated as the shape thereof. The term "axial direction" as used simply in the present modification unless otherwise stated also shall mean the direction in which the core wire connector 640 and the covering connector 550 are serially arranged.

In this core wire connector 640, as in the case with the core wire connector 540 in the embodiment, the core-wire exposing portion 513 is inserted between inner wall surfaces 642*b*, 642*b* through an opening 643 formed between respective free ends 642*a*, 642*a* of the piece portions 642, 642 (FIG. 12). The core-wire exposing portion 513 may stay above and at a distance from an inner wall surface (bottom surface) 641*a* of the bottom portion 641 because of the thickness of the covering 511 or may be mounted on the inner wall surface 641*a* of the bottom portion 641 due to the self-weight thereof. This core-wire exposing portion 513 is physically and electrically connected to the core wire connector 640 via the inner wall surface 641*a* of the bottom portion 641 and via the respective inner wall surfaces 642*b*, 642*b* of the piece portions 642, 642.

The arc-shaped inner wall surface 641*a* of the bottom portion 641 may be formed in an arc of a circle having the same diameter as the core wire diameter D1 of the core-wire exposing portion 513 or may be formed in a shape such that a section of the core-wire exposing portion 513 perpendicular to the axis line forms an inscribed circle to the inner wall surface 641*a* when the core-wire exposing portion 513 mounted on inner wall surface 641*a*. When such a perpendicular section of the core-wire exposing portion 513 forms the inscribed circle, the core wire diameter D1 of the core-wire exposing portion 513 is smaller than a distance S1 between the respective inner wall surfaces 642*b*, 642*b* of the piece portions 642, 642 in the inside of the core wire connector 640. Thus, a gap can be created between each of the inner wall surfaces 642*b*, 642*b* of the piece portions 642, 642 and the core-wire exposing portion 513.

The respective piece portions 642, 642 are projected in the same direction from the two opposite ends of the bottom portion 641 and are arranged facing each other with the respective inner wall surfaces 642*b*, 642*b* thereof spaced from each other at the distance S1 (FIG. 12). In the core wire connector 640 described herein, the bottom portion 641 is arc-shaped and plate-shaped while the piece portions 642, 642 are shaped in rectangular flat plates and have the same plate thickness. The term "width direction" as used simply in the present modification unless otherwise stated also shall mean the direction in which the pair of piece portions 642, 642 are arranged facing each other.

The core wire diameter D1 of the electric wire 510 that this terminal fitting 620 can be connected to may have: a size such that the core-wire exposing portion 513 can be completely housed inside a space surrounded by the bottom portion 641 and the pair of piece portions 642, 642; or a size such that the core-wire exposing portion 513 cannot be completely housed inside the space. However, also in the present modification, so that operation of holding down the core-wire exposing portion 513 using the holding-down jig 120 described below can be facilitated, the core wire diameter D1 of the electric wire 510 that the terminal fitting 620 described herein is connected to has a size that is smaller than a projection height H by which the piece portions 642, 642 are projected from a lowermost surface 641$a_1$ of the bottom portion 641 (FIG. 12). That is, the terminal fitting 620 described herein is connected to the electric wire 510 that has a size such that the core-wire exposing portion 513 can be completely housed inside the foregoing space. The lowermost surface 641$a_1$ of the bottom portion 641 is defined in the same manner as in the embodiment, and means a portion that is, within the inner wall surface 641*a* of the bottom portion 641, the most distant from the opening 643 formed between the respective free ends 642*a*, 642*a* of the piece portions 642, 642. The core wire connector 640 is shaped in such a manner that the projection height H of the piece portions 642, 642 from the lowermost surface 641$a_1$ of the bottom portion 641 is larger than the core wire diameter D1 of the core-wire exposing portion 513. In addition, conditions for the electric wire 510 that the terminal fitting 620 can be connected to include, in addition to the condition relating to the projection height H, that the core wire diameter D1 is equal to or smaller than the distance S1 between the respective inner wall surfaces 642*b*, 642*b* of the piece portions 642, 642. Thus, the core wire connector 640 is shaped in such a manner that the distance S1 between the respective inner wall surfaces 642*b*, 642*b* of the piece portions 642, 642 is equal to or larger than the core wire diameter D1 in the core-wire exposing portion 513.

According to the manufacturing method and apparatus 1 for the terminal-attached electric wire 502 in the present modification, a terminal placing step and an electric-wire placing step are performed in the same manner as the corresponding steps in the embodiment. Thereafter, an electric-wire holding-down step is performed using the holding-down jig 120 according to the present modification.

The aforementioned holding-down jig 20 in the embodiment transmits the laser beam LB. In the present modification, however, the holding-down jig 120 is formed in such a manner as to allow the laser beam LB to pass through a passage therein. The holding-down jig 120 includes a laser passage portion 128 that the laser beam LB emitted from the laser device 30 passes through and that radiates, to the core-wire exposing portion 513, the laser beam LB that has passed through the laser passage portion 128 (FIG. 11 and FIG. 12). The holding-down jig 120 described herein as an example is obtained by forming, in the holding-down jig 20 in the aforementioned embodiment, a through-hole that causes the third wall surface 23 and the sixth wall surface 26 to communicate with each other. The through-hole is used as the laser passage portion 128.

The laser passage portion 128 described herein extends from the first wall surface 21 to the second wall surface 22. The width of this laser passage portion 128 between the fourth wall surface 24 and the fifth wall surface 25 is determined in accordance with the width of the laser beam LB. For example, the width of the laser passage portion 128 is set to a size that enables the laser beam LB to pass therethrough and enables the core-wire exposing portion 513 to be melted by the laser beam LB that has passed and been radiated.

As in the case of the holding-down jig 20 in the embodiment, this holding-down jig 120 is formed in such a manner that a length from the first wall surface 21 to the second wall surface 22 is at least greater than or equal to the respective lengths of the piece portions 642, 642 in the axial direction. The holding-down jig 120 described herein is formed in such a manner that the length is equal to the respective lengths of the piece portions 642, 642 in the axial direction. Furthermore, so as not to rotate relative to the core wire connector 540, the holding-down jig 120 described herein is formed in such a manner that a length (the width thereof) from the fourth wall surface 24 to the fifth wall surface 25 is equal to the distance S1 between the respective inner wall surfaces 642*b*, 642*b* of the piece portions 642, 642 as in the case of the holding-down jig 20 according to the embodiment.

At the electric-wire holding-down step in the present modification, as a result of inserting the holding-down jig 120 between the pair of piece portions 642, 642 through the opening 643, the core-wire exposing portion 513 is held down by portions of the groove portion 27 that are on the first wall surface 21 side and on the second wall surface 22 side of the holding-down jig 120, and is pressed against the inner wall surface 641*a* of the bottom portion 641 by these portions of the groove portion 27 of this holding-down jig 120. Consequently, the core-wire exposing portion 513 is held down by the holding-down jig 120 while being kept directly visible through the laser passage portion 128.

At a melting step according to the present modification, the laser beam LB is emitted from the laser device 30 toward the laser passage portion 128 of the holding-down jig 120, whereby the laser beam LB that has passed through the laser passage portion 128 is radiated to the core-wire exposing portion 513 (FIG. 12). For example, the laser beam LB in the present modification may be radiated in the same width as the width of the laser passage portion 128 in a width direction, so that all of the laser beam LB that has passed through the laser passage portion 128 is radiated to the core-wire exposing portion 513. Alternatively, the laser beam LB in the present modification may be radiated in a width smaller than the width of the laser passage portion 128 in the width direction, so that all of the laser beam LB that has passed through the laser passage portion 128 is radiated to the core-wire exposing portion 513. Further alternatively, the laser beam LB in the present modification may be radiated in a width larger than the width of the laser passage portion 128 and equal to or smaller than the core wire diameter D1 of the core-wire exposing portion 513 in the width direction. In this case, of the laser beam LB, part that has passed through the laser passage portion 128 and part that has been transmitted by the holding-down jig 120 between each of the fourth wall surface 24 and the fifth wall surface 25 and the laser passage portion 128 are radiated to the core-wire exposing portion 513.

At the melting step, as in the case of the aforementioned embodiment, the laser beam LB is radiated to the core-wire exposing portion 513 until the core-wire exposing portion 513 is melted. At this melting step, the laser beam LB is swept, for example, from the first wall surface 21 side of the holding-down jig 120 to the second wall surface 22 side thereof as in the case of the aforementioned embodiment.

Thereafter, according to the manufacturing method and apparatus 1 for the terminal-attached electric wire 502 in the present modification, a fixing step and a pressure-bonding step are performed in the same manner as the corresponding steps in the embodiment. FIG. 13 illustrates an example of a state in which the core-wire exposing portion 513 and the core wire connector 640 are fixed to each other after the fixing step.

The manufacturing method and apparatus 1 for the terminal-attached electric wire 502 in the present modification can provide the same effect as those in the aforementioned embodiment even by using the holding-down jig 120 described herein.

Note that, while the holding-down jigs 20 and 120 that are solid are described as examples in the aforementioned embodiment and modification, a holding-down jig may have the following shape although not being illustrated. This holding-down jig has a first wall body having the first wall surface 21 and shaped in a rectangular flat plate, and a second wall body having the second wall surface 22 and shaped in a rectangular flat plate, and is a molded body that holds down the core-wire exposing portion 513 via the respective end surfaces of the first wall body and the second wall body. This holding-down jig has at least one linking wall body that links the first wall body and the second wall body together. For example, this holding-down jig has a first linking wall body, a second linking wall body, and a third linking wall body as the at least one linking wall body. The first linking wall body is a wall body shaped in a rectangular flat plate and having the third wall surface 23 and links the first wall body and the second wall body together on one side of the holding-down jig that faces away from the core-wire exposing portion 513. The second linking wall body is a wall body shaped in a rectangular flat plate and having the fourth wall surface 24 and links the first wall body and the second wall body together on one side of the holding-down jig that corresponds to one of the piece portions 542, 542 (642, 642). The third linking wall body is a wall body shaped in a rectangular flat plate and having the fifth wall surface 25 and links the first wall body and the second wall body together on one side of the holding-down jig that corresponds to the other of the piece portions 542, 542 (642, 642). Furthermore, this holding-down jig has respective portions that are dented portions obtained by denting, toward the third linking wall body, the end surfaces of the first wall body and the second wall body that face the core-wire exposing portion 513 and correspond to the groove portions 27 in the holding-down jig 120. This holding-down jig holds down, via the dented portions on the end surfaces of the first wall body and the second wall body that face the core-wire exposing portion 513, one side of the core-wire exposing portion 513 that faces the opening 543 (643). In addition, this holding-down jig may allow the laser beam LB to be transmitted by the first linking wall body or may be provided with a through-hole, as a laser passage portion, in the first linking wall body to allow the laser beam LB to pass through the laser passage portion.

The terminal-attached electric wire manufacturing method and apparatus according to the present embodiment causes the core-wire exposing portion to be held down by the holding-down jig before the melting step. Therefore, when the core-wire exposing portion is composed of two or more element wires, the element wires in the core-wire exposing portion do not unravel, whereby the core-wire exposing portion can be irradiated with a laser beam without the element wires hanging out of the core wire connector. That is, these terminal-attached electric wire manufacturing method and apparatus can, by use of the holding-down jig, prevent unraveling of the element wires without the need of providing the terminal fitting with any device for preventing unraveling of the element wires and thus melt the core-wire exposing portion with a laser beam in that state. Therefore, these terminal-attached electric wire manufacturing method and apparatus according to the present embodiment can provide enhanced conduction quality between the electric wire and the terminal fitting by making the connection between the core-wire exposing portion and the core wire connector favorable and stable even when the terminal fitting does not include a device for preventing unraveling of the element wires. In addition, these terminal-attached electric wire manufacturing method and apparatus are excellent in versatility because, for example, an existing one can be used as the terminal fitting.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal-attached electric wire manufacturing method comprising:

an electric wire placing step of placing and inserting a core-wire exposing portion at a terminal end of an electric wire between inner wall surfaces of a pair of piece portions of a terminal fitting that has a core wire connector composed of a bottom portion and the piece portions, the piece portions being projected from two opposite ends of the bottom portion;

an electric wire holding-down step for holding down the core-wire exposing portion, by a holding-down jig, from sides of free ends of the piece portions and pressing the core-wire exposing portion against an inner wall surface of the bottom portion by use of the holding-down jig, the holding-down jig being made of a laser-transmissive material that has a higher melting point than the melting point of the core core-wire exposing portion, composed of a plurality of element wires, and the core wire connector;

a melting step of melting by irradiating the core-wire exposing portion with a laser beam through the holding-down jig from the sides of the free ends of the piece portions until the core-wire exposing portion is melted; and a fixing step of fixing the core-wire exposing portion to the core wire connector by stopping irradiation with the laser beam and removing the holding-down jig, whereby the core-wire exposing portion is fixed to the core wire connector upon solidification of the core-wire exposing portion, and wherein the electric wire holding-down step includes holding down the core-wire exposing portion, by a groove portion of the holding-down jig, the holding-down jig having a length at least equal to or larger than the respective lengths of the piece portions in the direction of the axis line of the core-wire exposing portion, and having a width equal to the distance between the respective inner wall surfaces of the piece portions.

2. The terminal-attached electric wire manufacturing method according to claim 1, wherein the electric wire holding-down step includes inserting, between the respective inner wall surfaces of the piece portions, the core-wire exposing portion of the electric wire that has a core wire diameter smaller than a projection height of the respective piece portions from a lowermost surface of the bottom portion.

3. The terminal-attached electric wire manufacturing method according to claim 2, wherein the melting step includes irradiating the core-wire exposing portion with the laser beam that has passed through a laser passage portion of the holding-down jig.

4. The terminal-attached electric wire manufacturing method according to claim 1, wherein the melting step includes irradiating the core-wire exposing portion with the laser beam that has passed through a laser passage portion of the holding-down jig.

* * * * *